US005255400A

United States Patent [19]

Sween

[11] Patent Number: 5,255,400

[45] Date of Patent: Oct. 26, 1993

[54] APPARATUS FOR CONTAINING A LIQUID

[76] Inventor: Adrian P. Sween, Rte. 3, Box 214B, Little Falls, Minn. 56345

[21] Appl. No.: 921,363

[22] Filed: Jul. 28, 1992

Related U.S. Application Data

[63] Continuation of Ser. No. 555,661, Jul. 18, 1990, abandoned, which is a continuation of Ser. No. 298,821, Jan. 18, 1989, abandoned, which is a continuation of Ser. No. 45,768, Apr. 28, 1987, abandoned, which is a continuation of Ser. No. 834,112, Feb. 24, 1986, abandoned, which is a continuation of Ser. No. 552,670, Nov. 17, 1983, abandoned.

[51] Int. Cl.[5] ..... A47K 3/02

[52] U.S. Cl. ..... 4/556; 4/584

[58] Field of Search ..... 4/538, 549-551, 4/553-556, 559, 546-548, 584, 589-591, 625

[56] References Cited

U.S. PATENT DOCUMENTS

| | | | |
|---|---|---|---|
| 248,790 | 10/1881 | Prewitt | 4/545 |
| 297,081 | 4/1884 | Koons | 4/553 X |
| 746,390 | 12/1903 | Schmidt | 4/556 |
| 1,277,709 | 9/1918 | Ferrandini | 4/553 X |
| 1,377,803 | 5/1921 | Bush | 4/538 X |
| 1,381,012 | 6/1921 | Raiche | 4/538 X |
| 2,116,133 | 5/1938 | Allen | 4/625 |
| 2,267,513 | 12/1941 | Waterman | 4/538 X |
| 2,778,028 | 1/1957 | Weiner | 4/400 |
| 2,991,482 | 7/1961 | Brass . | |
| 3,156,931 | 11/1964 | Holtman | 4/584 |
| 3,371,354 | 3/1968 | Hayslett . | |
| 3,380,078 | 4/1968 | Hanson . | |
| 3,496,579 | 2/1970 | Petersen | 4/590 |
| 3,662,409 | 5/1972 | Johansson . | |
| 3,663,971 | 5/1972 | Bonhote | 4/556 |
| 3,719,960 | 3/1973 | Russell . | |
| 3,863,275 | 2/1975 | Brendgord et al. . | |
| 4,118,810 | 10/1978 | Brickhouse et al. . | |
| 4,334,378 | 6/1982 | Delepine | 4/191 |
| 4,420,846 | 12/1983 | Bonner | 4/542 |
| 4,583,251 | 4/1986 | Karl et al. | 4/555 |

FOREIGN PATENT DOCUMENTS

| | | | |
|---|---|---|---|
| 168894 | 1/1951 | Fed. Rep. of Germany | 4/549 |
| 1582900 | 1/1981 | United Kingdom | 4/555 |

OTHER PUBLICATIONS

Brochure, "Centural Patient Bathing System", Century Manufacturing Company, Industrial Park, Aurora, Nebr. 68818.

Brochure, "Arjo Bath Tub with Control Panel", B0745, Arjo Hospital Equipment AB, Box 61, S-241 00 Eslov, Sweden.

Brochure, "The Bather Silcraft Corporation", Silcraft Corporation, P.O. Box 335, 5168 US 31 North, Acme, Mich. 49610.

*Primary Examiner*—Charles E. Phillips

*Attorney, Agent, or Firm*—Merchant, Gould, Smith, Edell, Welter & Schmidt

[57] ABSTRACT

The present invention is directed to bathing tub apparatus primarily for invalid persons. The apparatus includes a tub with a sealable door through which a person may walk or be moved on a transfer unit. The apparatus further includes a prefillable reservoir positioned above the tub. Liquid may be rapidly released to fall from the reservoir into the tub to quickly fill the tub and prevent the person therein from becoming chilled or uncomfortable. The reservoir may then be refilled with preheated liquid while the person is bathing. The reservoir is held by a support unit which serves as a storage cabinet within and a shelf without and which may be moved longitudinally with respect to the tub to provide for cleaning and repair behind the tub. The tub includes a liquid circulation system for agitating the liquid to enhance therapeutic and cleansing effects. A hand held shower may also be used by the person in the tub.

7 Claims, 7 Drawing Sheets

APPARATUS FOR CONTAINING A LIQUID

This is a continuation of application Ser. No. 07/555,661, filed Jul. 18, 1990 (abandoned), which is a continuation of application Ser. No. 07/298,821, filed Jan. 18, 1989 (abandoned), which is a continuation of application Ser. No. 07/045,768, filed Apr, 28, 1987 (abandoned), which is a continuation of application Ser. No. 06/834,112, filed Feb. 24, 1986 (abandoned), which is a continuation of application Ser. No. 06/552,670, filed Nov. 17, 1983 (abandoned).

TECHNICAL FIELD

The invention is directed to an apparatus for containing a liquid and, more particularly, to bathing apparatus having a sealable door through which invalid persons and others may pass and a prefillable reservoir with a valve mechanism for rapidly releasing liquid into the tub.

BACKGROUND OF THE INVENTION

Simple containers for liquid and, more particularly, bathtubs are well known. Special bathing tubs for invalid persons are also known. A number of such tubs show various shapes and have a hinged door in a wall thereof. Some of such tubs include a platform for sitting. Some show the use of the tub for both soaking and showering. Most such tubs, however, are helpful only to partially disabled persons. That is, it is usually necessary that a person be able to step into the tub through the door and make the necessary movements inside the tub to situate himself for bathing. In addition, most tubs have a standard spigot filling mechanism which can result in a person sitting quite a long time in the tub and getting cold or can also result in too cold or too hot water contacting the person.

U.S. Pat. 746,390 shows a tub providing a more rapid tub fill than usual by having a jacket about the tub for containing water for subsequent release into the tub. The problem with a jacket reservoir, however, is that it either cannot fill with a person in the tub or it cannot completely empty into the tub and, consequently, it is not unlikely that some of the water will eventually become dirty or contaminated. Also, such tub requires considerably more water in the reservoir than is ever available for use in the tub.

U.S. Pat. No. 3,662,409 shows a tub more specifically designed for wheel-chair constrained disabled persons. A door is openable exposing tracks for supporting the chair portion of a wheelchair. Apparently, a person in a wheelchair may back up to the open door of the tub and push himself or have himself and the chair pushed off the carrier of the chair. Once the person and chair are fully supported in the tub, the door may be closed and the tub filled with water for bathing therein. After the water is drained from the tub and the door is opened, apparently the carrier is held in front of the door opening and the chair pulled onto the carrier. Although such tub and transfer unit is likely usable for certain disabled persons, the transition of the chair from either the tub or the chassis of the transfer unit to the other can be very frightening for a disabled person.

Additionally, other types of mechanisms may be used to move invalid or other persons from outside a tub to inside a tub. Some such mechanisms lift a person over the side wall of a tub. Such mechanisms, however, are particularly scary as a person can be several feet off the ground and at a height completely unfamiliar to them. Such circumstances for unclothed and often cold invalid persons can be and are very disconcerting.

Thus, prior art bathing systems and apparatus have not been designed with the best interest of the user in mind and are really quite dehumanizing. The present invention, on the other hand, solves these various problems and provides a significant advance in the treatment of infirmed people.

SUMMARY OF THE INVENTION

The present invention is directed to an apparatus for containing a liquid including a tub, a reservoir and a mechanism for supporting the reservoir elevated with respect to the tub. The apparatus further includes a mechanism for filling the reservoir with liquid and mechanism for releasing the liquid in the reservoir to the tub. The releasing mechanism includes other mechanism for distributing along one dimension the liquid released from the reservoir thereby to fall into the tub and create a waterfall appearance. The apparatus further includes a tub drain.

Another embodiment has the supporting mechanism holding the reservoir above a portion of the tub on first and second support members on opposite sides of the tub. Additionally, the filling mechanism of such apparatus includes mechanism for connecting the reservoir to a liquid source to allow movement of the supporting mechanism and the reservoir thereon with respect to the tub thereby facilitating cleaning and repair to and behind the tub and the supporting mechanism.

In addition, the present invention has an embodiment for a bathing system including a tub with a door and mechanism for operating the door. The system includes a wheeled transfer unit for moving an invalid person. The transfer unit has a chair and a carrier for the chair. The carrier includes mechanism for supporting the chair from outside the tub as the chair is moved through the door of the tub to the inside of the tub.

A further embodiment is directed to a bathing tub apparatus having a door and mechanism for operating the door. The tub has an inner surface and outer walls along opposite sides. The inner surface is shaped to include a raised portion for a person to sit thereon. The outer walls have upper and lower portions. The upper portions are inclined inwardly, while the lower portions include relief portions adjacent to the floor for a first person to easily stand with his feet in the relief portions to allow him to lean against one of the inclined upper portions to bathe a second person within the tub. The tub further includes mechanism for filling the tub and mechanism for draining the tub.

Also, the present invention is directed to a method for cleansing a person including firstly the step of opening a door on a bathtub. Nextly, the person is moved through the open door and into the tub, such person being on a transfer unit including a chair and a carrier for the chair when the carrier supports the chair from outside the tub. Then, the method includes closing the door, bathing the person, opening the door and moving the person on the chair supported by the carrier from the tub.

Another method of the present invention is directed to installing bathing apparatus which includes firstly connecting an implaced drain system to a tub. Next, supporting mechanism for a reservoir with the reservoir thereon is slid past a portion of the tub, said supporting mechanism having portions passing along opposite sides and the top of the tub. Then, water source means is connected to the reservoir. Finally, the supporting mechanism is slide past a further portion of the tub to a final installation location.

Thus, the several embodiments and methods of the present invention each provide for liquid containing apparatus which solves the problems of the prior art. For example, the present invention includes a reservoir separate from the tub. The reservoir may be prefilled with a liquid, usually water, having a desired temperature. The liquid may be rapidly dumped from the reservoir into the tub. All water is drained from the reservoir virtually eliminating any possibility of contamination. Additionally, the rapid fill vastly reduces the likelihood of discomfort or chill to the person in the tub. Furthermore, the reservoir may be refilled while the person is bathing so a second person may be bathed as soon as water drains when the first person has left or, if water becomes too soiled, it may be drained and the tub refilled rapidly to complete the bathing of the first person.

The tub of the present invention is further advantageous because of a hinged door at an end thereof. The door may be swung away from the door opening to provide for easy access to the tub by a person stepping therein or by moving a person on the chair of a transfer unit through the opening to a location therein. With the door closed and sealed, as indicated, the reservoir may be rapidly dumped thereby providing for quick filling of the tub to prevent the person from getting cold or otherwise becoming or remaining uncomfortable for an excessive period of time.

In addition, the reservoir is advantageously supported by a cabinet unit which may be slid past the tub thereby facilitating repair and cleaning in areas otherwise behind the support unit at one end of the tub.

Another advantage provides for a tub having upper walls inclined inwardly so that a helper can easily lean against the side walls and bath a person therein. Also, the tub has recesses along the lower portions adjacent to the floor so that the same person can easily locate his feet next to the tub.

These and more advantages and objects obtained by this invention are explained hereinafter. Also, the invention is better understood by reference to the drawings and the descriptive matter thereof which follows, the drawings illustrating a preferred embodiment.

DETAILED DESCRIPTION OF THE PREFERRED EMBODIMENT

Figure 1:
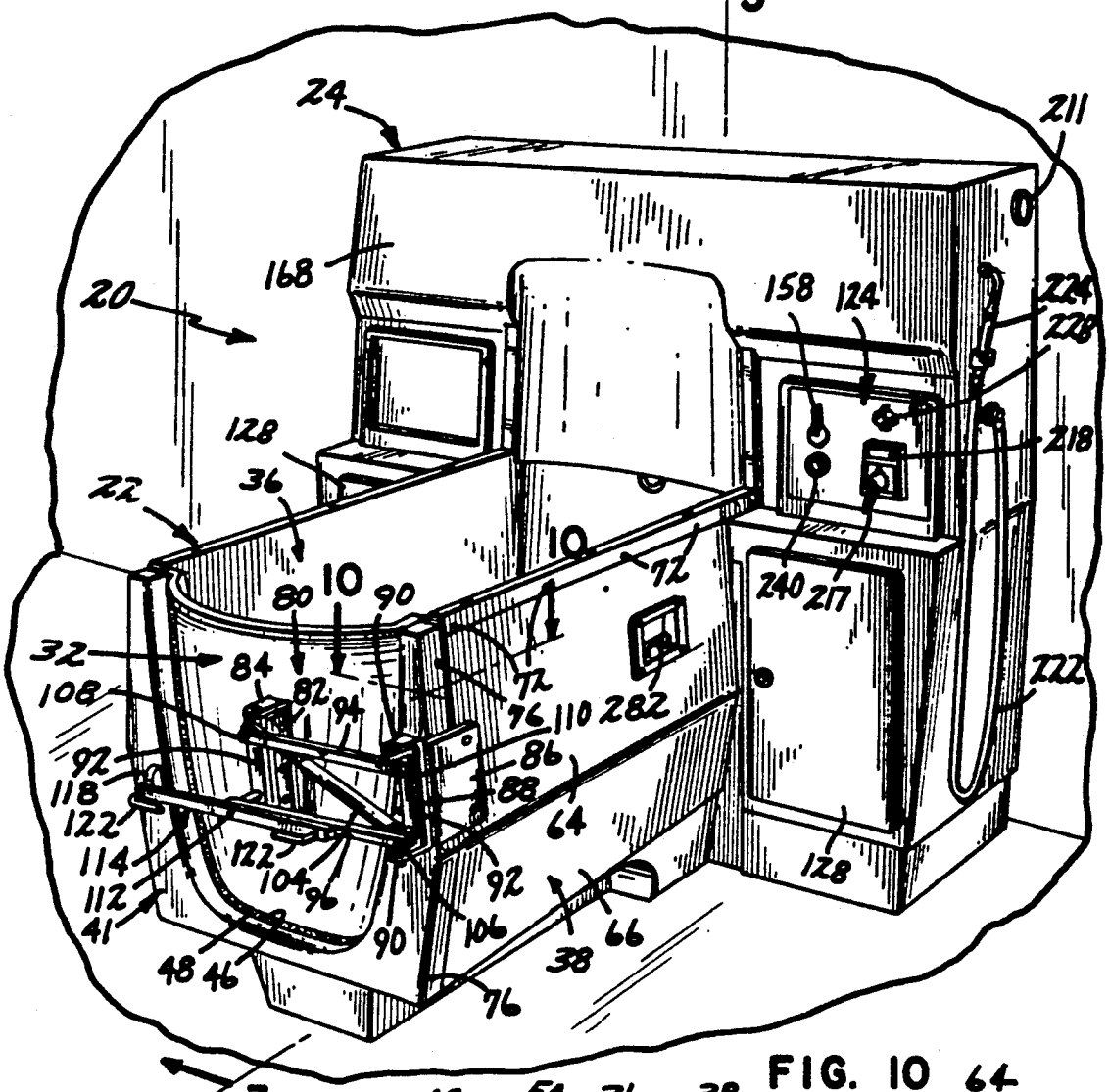
FIG. 1 is a perspective view of an apparatus in accordance with the present invention.
Figure 3:
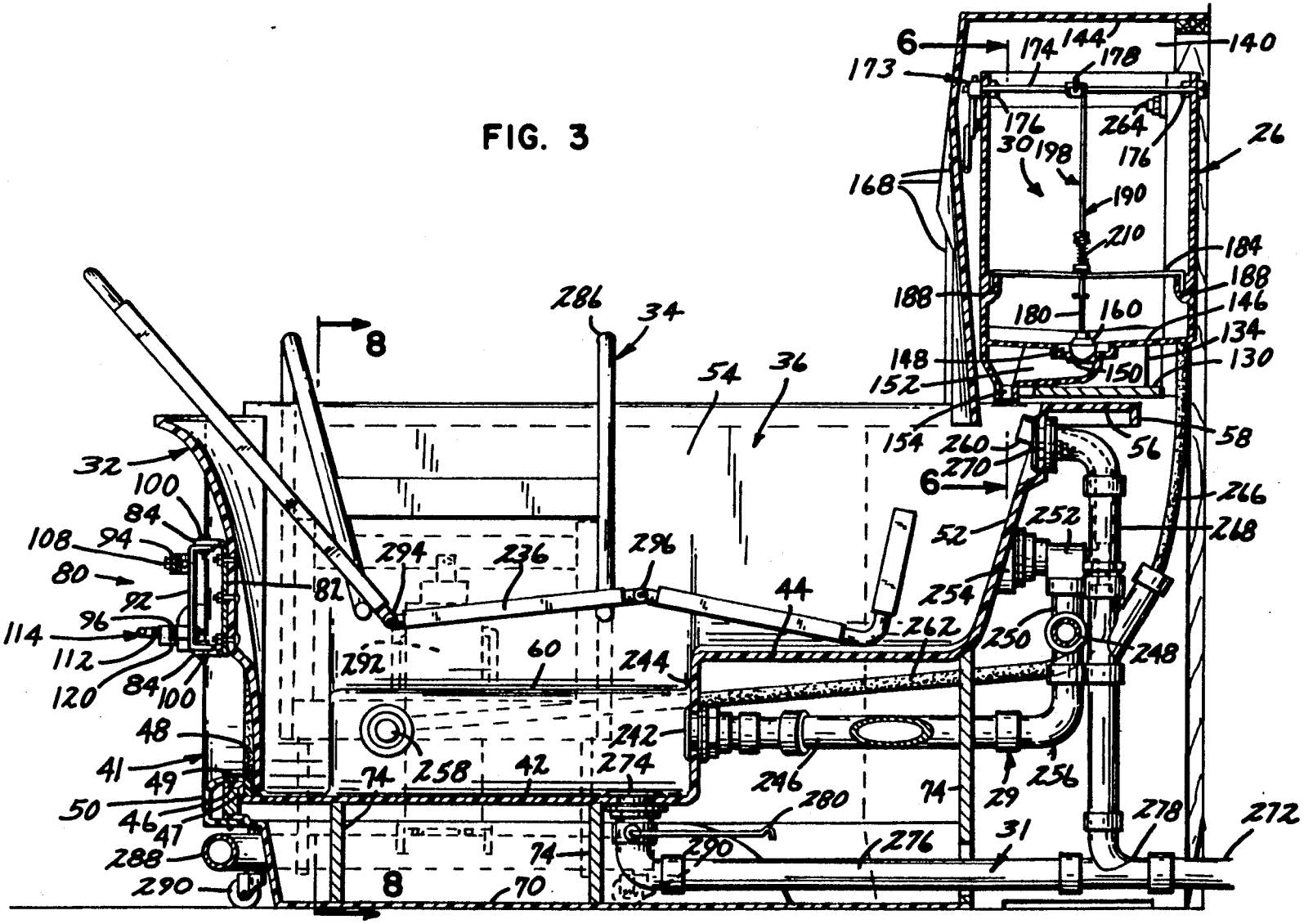
FIG. 3 is a cross-sectional view taken along line 3—3 of FIG. 1 wherein an exemplary transfer unit is shown in side view holding a chair within the tub.
Figure 4:
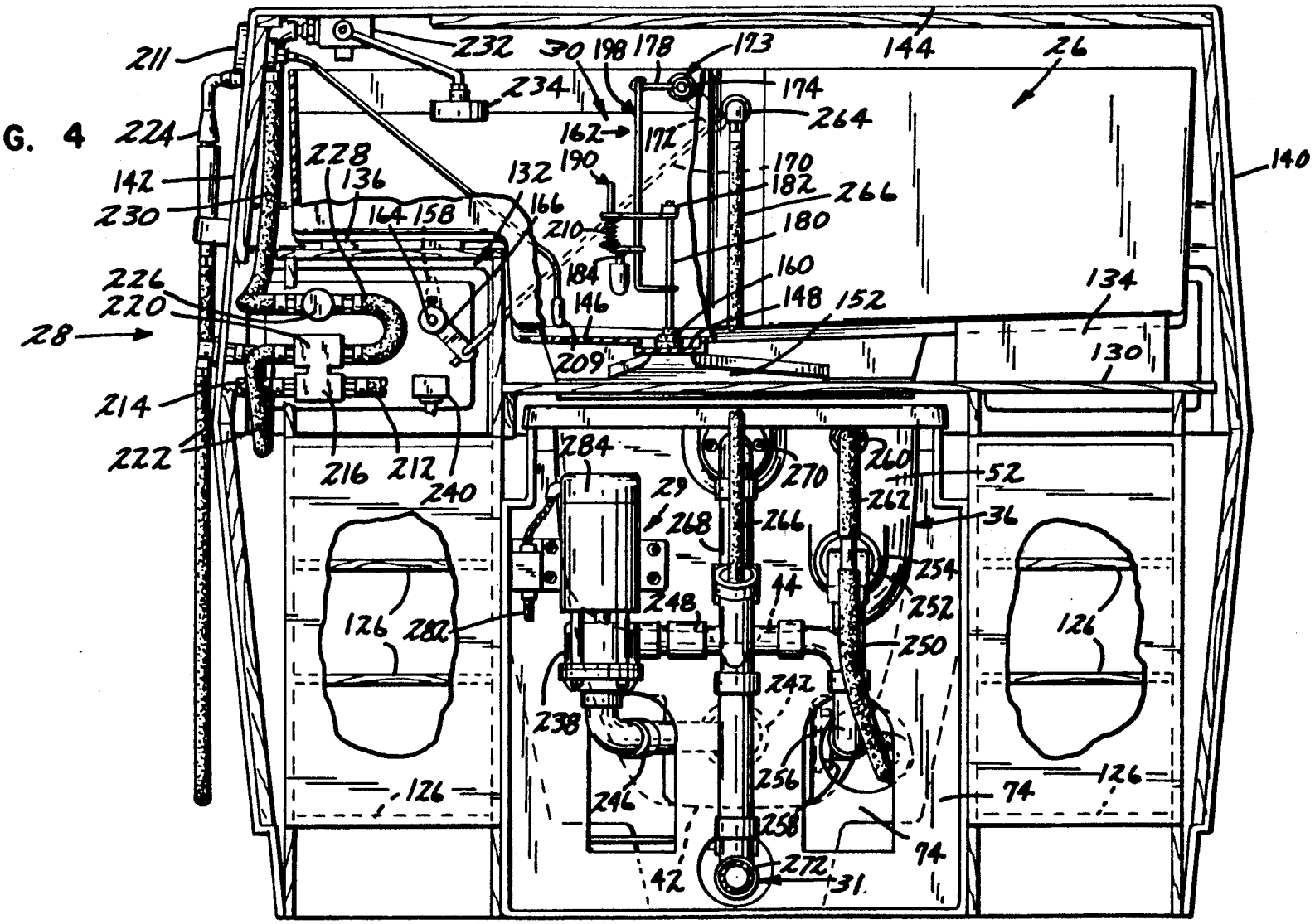
FIG. 4 is a rear view of the apparatus of FIG. 1, with portions broken away and portions shown in partial cross section.
Figure 5:
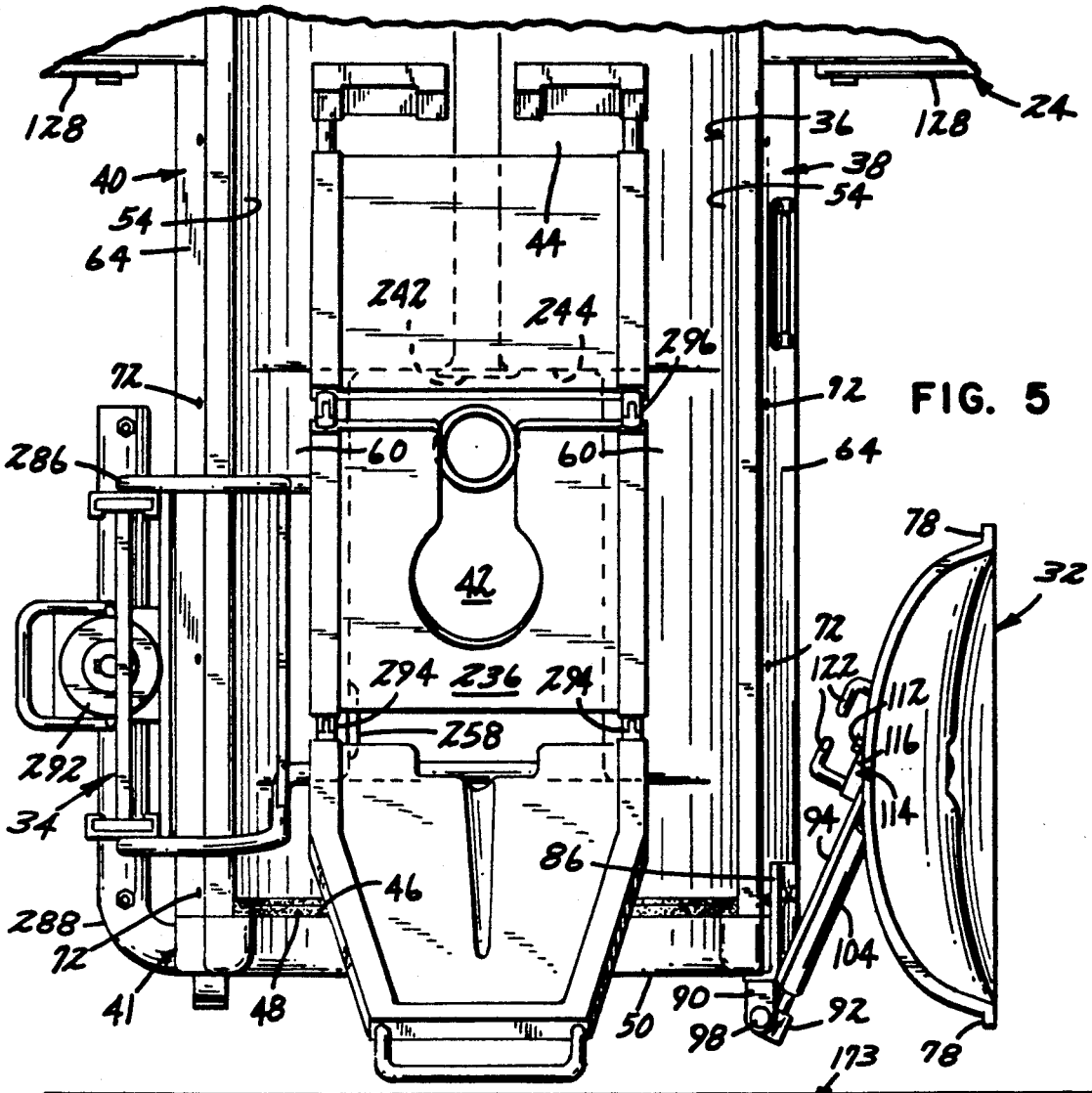
FIG. 5 is a top view of a portion of the apparatus of FIG. 1 and shows the exemplary transfer unit of FIG. 3.

Referring now to the drawings wherein like reference numerals designate identical or corresponding parts throughout the several views, and more particularly to FIG. 1, an apparatus for containing liquid in accordance with the present invention is designated generally by the numeral 20. Apparatus 20 includes generally a tub 22 and a support cabinet 24. As shown in FIGS. 3 and 4, support cabinet 24 provides support for a reservoir 26. A liquid source plumbing system 28 provides for filling reservoir 26. A dump valve 30 controls release of liquid within reservoir 26 to fall under gravity into tub 22. Liquid, usually water, within tub 22 may be agitated by a circulating system 29 to provide cleansing and massaging action to the liquid. The liquid is drained from tub 22 through drain system 31 (see FIG. 3). Tub 22 includes a sealable door 32. On opening the door, a person may walk into or out of the tub or a person may be moved into or out of the tub using a transfer unit 34, as shown in FIG. 5.

Figure 8:
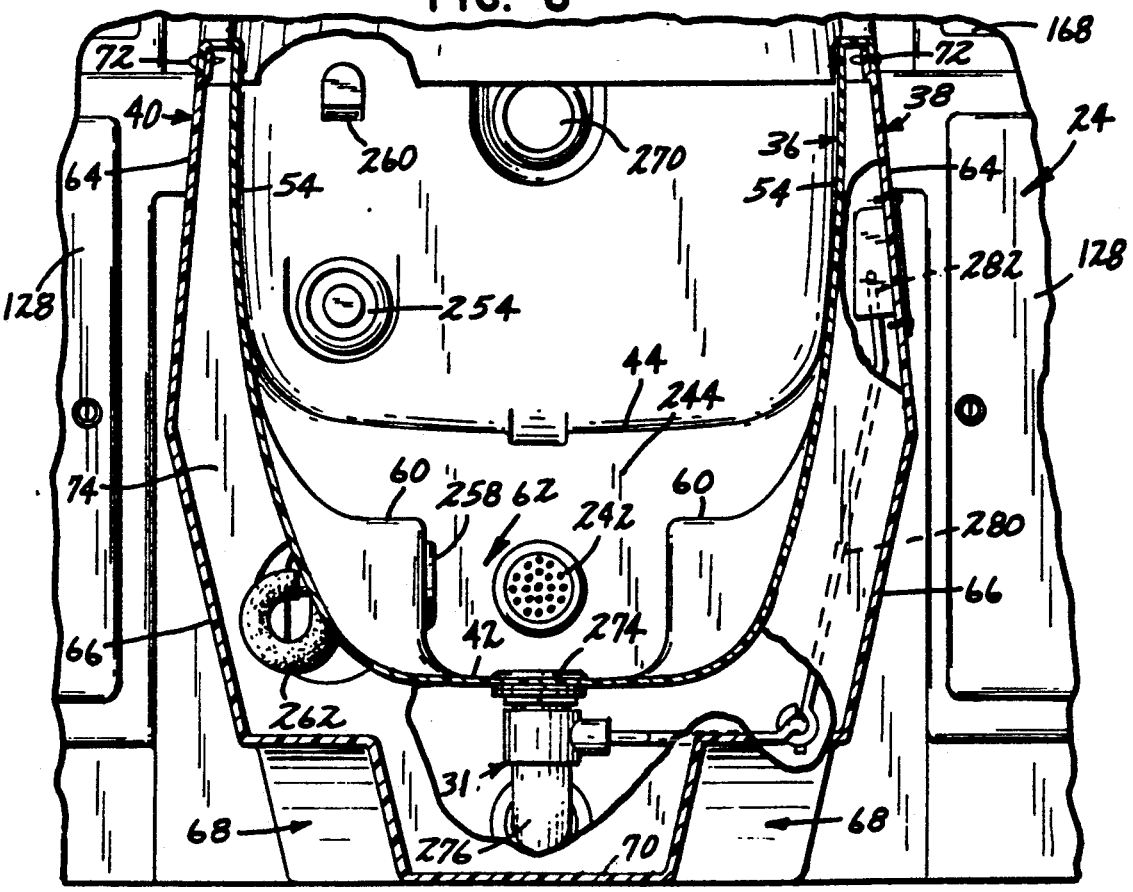
FIG. 8 is a cross-sectional view taken along line 8—8 of FIG. 3.

Tub 22 is made preferably from a mold using fiberglass or similar materials. As shown in FIGS. 3 and 8, tub 22 has a containing wall 36, as well as side walls 38 and 40 and an end frame 41 (see FIG. 1) which cooperates with door 32. As shown in FIG. 3, containing wall 36 has a bi-level bottom surface. Lower surface 42 is a convenient distance beneath higher surface 44 so that a person may sit on higher surface 44 and comfortably have his feet on lower surface 42. It is noted that higher surface 44 could be slanted downwardly toward end 52 to be more comfortable for a sitting person. In either case, suface 44 preferably includes a depressed portion for drainage to trough 62.

The door end of lower surface 42 forms a small step 46 up from surface 42 (see FIG. 10) and has a portion 47 perpendicular to surface 42 and a portion 49 parallel to surface 42. Portion 47 provides support for door seal 48, and portion 49 provides support for a portion of U-shaped wall 50 of frame 41. The other end 52 of containing wall 36 is slanted outwardly as it rises from higher surface 44. Containing wall 36 also includes sidewalls 54 which rise to the same height as end 52. Walls 54 mate at arcuate corners with lower and higher surfaces 42 and 44 and end 52. A substantially horizontal flange 56 extends outwardly from side walls 54 and 52 and has a downwardly extending portion 58 at its outermost end.

Tub 22, as shown most clearly in FIG. 8, further includes a pair of side shelves 60 to create a trough 62 therebetween with surface 42 forming the bottom of trough 62. Shelves 60 are located toward door 32 from upper surface 44, but stop short of door 32 a sufficient distance to allow the necessary inward movement of door 32 as it moves from a sealed position to an open position explained in more detail hereinafter. Shelves 60 are formed by side walls 54 extending arcuately inwardly before dropping to form substantially vertical sides for trough 62.

Outer side walls 38 and 40 extend from frame 41 to the opposite end of tub 22. Side walls 38 and 40 have an upper portion 64 and a lower portion 66. Upper portion 64 is inclined inwardly as it rises, while lower portion 66 is inclined inwardly as it extends toward the floor. As the lower portions 66 approach the floor they are formed to create recesses 68 so that a first person helping to bathe a second person may conveniently place the forward portions of his feet within the recesses 68. That is, before lower portions 66 reach the floor they extend inwardly toward one another and then downwardly to a common surface 70 which rests on the floor. Recesses 68 extend longitudinally from the door end of tub 22 to approximately midway along upper surface 44 within tub 22.

Containing wall 36 is attached to outer side walls 38 and 40 with screws or other known fastening mechanism 72 at a location where they meet near the top of tub 22. Additionally, containing wall 36 is supported and spaced apart from the side walls 38 and 40 by a plurality of supports 74 spaced along the longitudinal length of tub 22. Each of supports 74 is appropriately shaped to provide the support required at the particular location where it is placed. Supports 74 are appropriately fastened in place.

Figure 10:
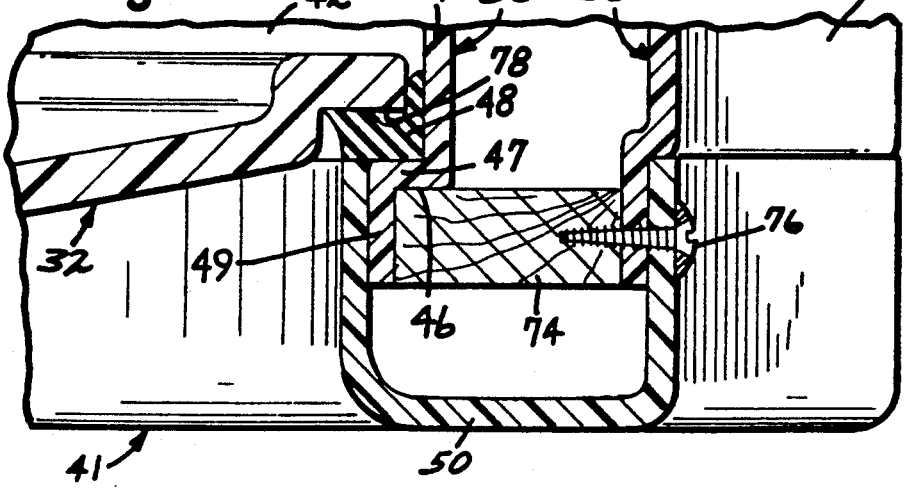
FIG. 10 is a cross-sectional view taken along line 10—10 of FIG. 1.

Door frame 41 is shown most clearly in FIGS. 1 and 10. Frame 41 provides a cap across the ends of containing wall 36 and side walls 38 and 40. Consequently, door frame 41 is substantially U-shaped with its base or face end conforming with the shape of containing wall 36 at the door and with walls 38 and 40 along the sides. The cross sectional shape at any particular location on frame 41 is generally U-shaped also, as shown in FIG. 10. A support 74 extends between side wall 38 or 40 and containing wall 36. Wall 50 of frame 41 is held in place by a plurality of screws 76 or other fastening mechanism. Gasket 48 butts against step 46 and the inner end of wall 50 of frame 41 to form a seal between those surfaces and door 32 when door 32 is locked closed.

Door 32 spans across the end opening between inner side walls 54 as well as reaches from bottom 42 to a level approximately flush with flange 56. Door 32 may be bowed outwardly as shown in FIGS. 1 and 3 or it may be flat or some other shape. In any case, it includes an outer surface 78 for contact with gasket 48 to provide a seal.

Figure 7:
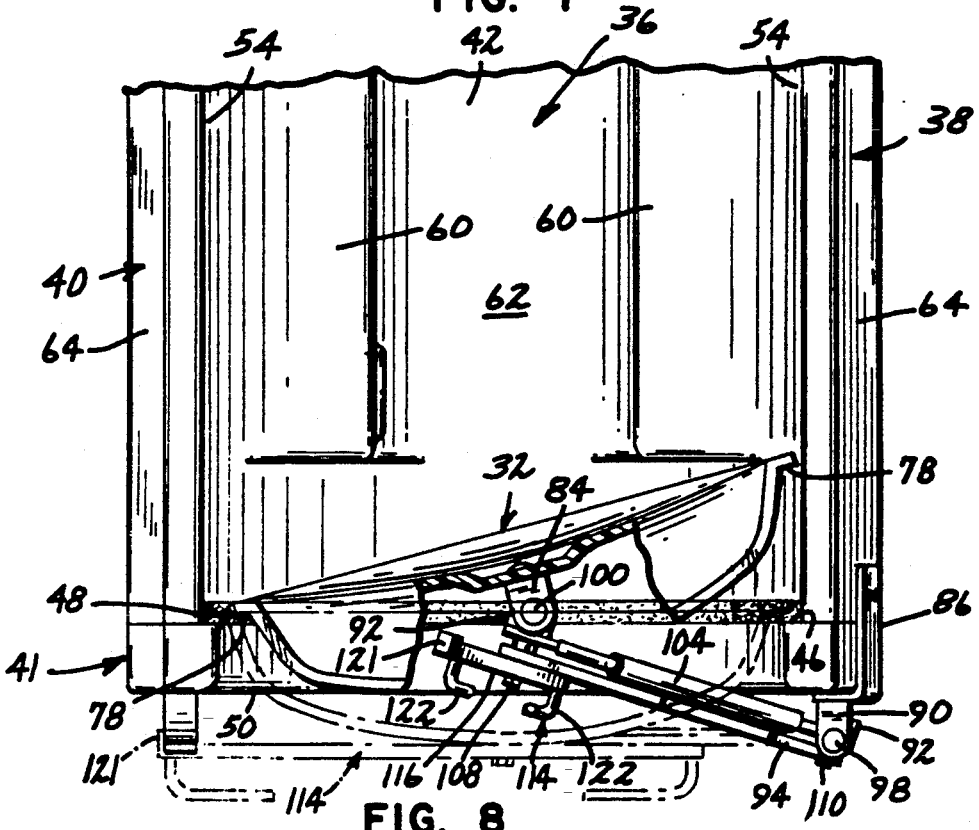
FIG. 7 is a top view, with a portion broken away and shown in cross section, showing in solid lines the door moved inwardly from its sealed position and showing in broken lines the door in its sealed position.
Figure 9:
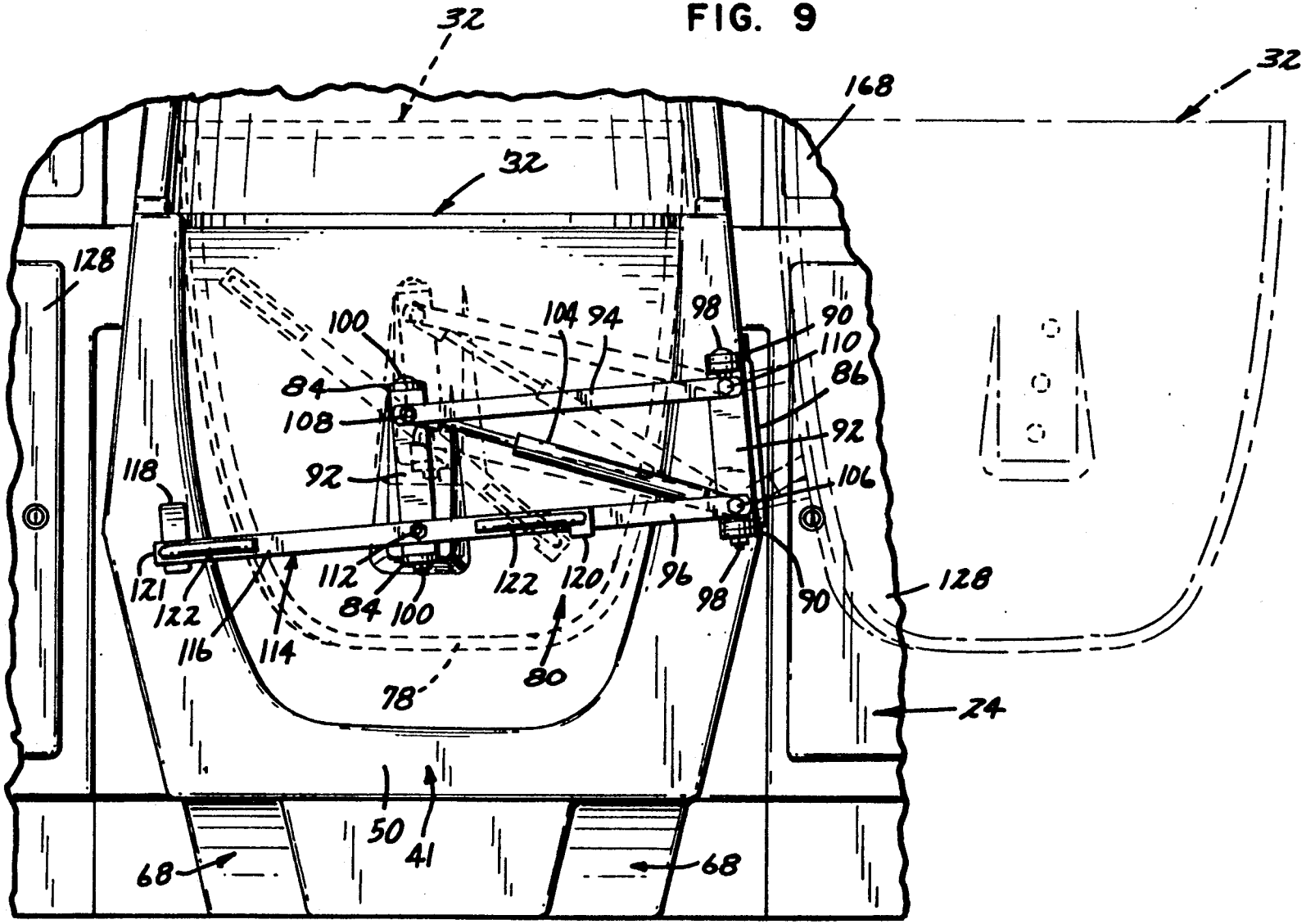
FIG. 9 is an end view of a portion of the apparatus of FIG. 1 showing in solid lines the door and hinge in its sealed position and showing in two separate sets of broken lines the door in a partially open position and in a fully opened position.

Hinge mechanism 80 functions to swing door 32 between open and closed positions as indicated in FIG. 9. It is understood that for the general feature of a swingable door, mechanism 80 as shown is exemplary and other hinge mechanisms could provide that feature. A preferred embodiment, however, is disclosed. As shown in FIG. 1, hinge 80 includes a vertically-extending U-shaped bracket 82 attached centrally to door 32 with the legs 84 of the bracket extending outwardly. A side bracket 86 may be attached either to frame 41 or, as shown in FIG. 1, to side wall 38. It is understood, of course, that bracket 86 could be attached to the other side of tub 22 at side wall 40 so as to provide a door swing in the opposite direction from that shown. In any case, bracket 86 includes a U-shaped portion 88, similar to bracket 82 with legs 90 extending outwardly from the face of frame 41. Smaller Ushaped, rotatable holders 92 are fastened with pivot pins 98 and 100 at the legs thereof to each of legs 90 and 84 of brackets 86 and 82. Near the ends of the bases of holders 92, parallel upper and lower rods 94 and 96 are pivotably attached. Such a configuration, provides for a parallelogram movement of rods 94 and 96. Thus, rods 94 and 96 pivot at the ends to lift door 32 as shown in FIG. 9. Also, holders 92 pivot about pivot pins 98 and 100, as shown in FIG. 7, so that door 32 may move from the inside of the tub to the outside.

Door 32 is aided in its upward movement by a pneumatic piston and cylinder assembly 104 attached between the lower, side pivot 106 of rod 96 and the upper, center pivot 108 of rod 94. The same function could be accomplished with an extension spring between the opposite two pivots of rods 94 and 96, namely at 110 and 112. Additionally, counterbalancing spiral hinges could be added to assist upward door movement.

Lock mechanism 114 forces door 32 into a sealing relationship with gasket 48. Lock mechanism 114 includes a member 116 rotatable about attachment 112. Member 116 is preferably a flat, rectangular item of metal extending from about midway on frame 41 near side wall 40 to about midway along rod 96. A receiver element 118 is attached to frame 41 and has a notch therein. The other end of member 116 has a stop 120 extending inwardly from the lower edge of member 116 to contact rod 96 thereby preventing member 116 from rotating any farther. Member 116 should be somewhat springy so that as it rotates to be parallel with rod 96, member 116 may slide over the upper side of receiver 118 and snap into the notch. At the same time, stop 120 contacts rod 96. Also, extension 121 extends inwardly from member 116 adjacent to the outer side of receiver 118 to hold tub 22 from springing outwardly when it is filled with liquid. Handles 122 on member 116 facilitate movement of member 116.

Thus, door 32 opens with a somewhat complex set of movements. Member 116 is first rotated clockwise. Then, pneumatic assembly 104 forces door 32 upwardly causing arms 94 and 96 to pivot at their ends and move in a parallelogram fashion to dotted position of FIG. 9. Next, door 32 is pivoted about pivot pins 100 and then about pivot pins 98 and moved outwardly as indicated in FIG. 9 by broken lines. A fully open door position is shown in FIG. 5.

Support cabinet 24 may assume a variety of shapes. In general, support cabinet 24 supports reservoir 26 above tub 22 in a location where reservoir 26 can dump liquid held therein into tub 22. Support cabinet 26 also conceals plumbing and provides a frame to which control devices may be attached as shown generally at 124 in FIG. 1. In the preferred embodiment, support cabinet 24 is a unitary item as shown most clearly in FIG. 2. The lower portion of each side of cabinet 24 includes a plurality of shelves 126 (see FIG. 4) behind swingable doors 128. The upper portion of cabinet 24, as shown in FIG. 4, includes a flat board or other similar item 130 extending from over one set of shelves to a compartment 132 for receiving the plumbing for the control elements 124. Reservoir 26 is supported at one side by a bracket 134 and at the other side by a pad 136 at the top of compartment 132. Preferably, reservoir 26 is made of fiberglass or a similar material. It may be desirable to include brackets or flat sheets extending from and integral with reservoir 26 for further fixed attachment to cabinet 24.

Figure 6:
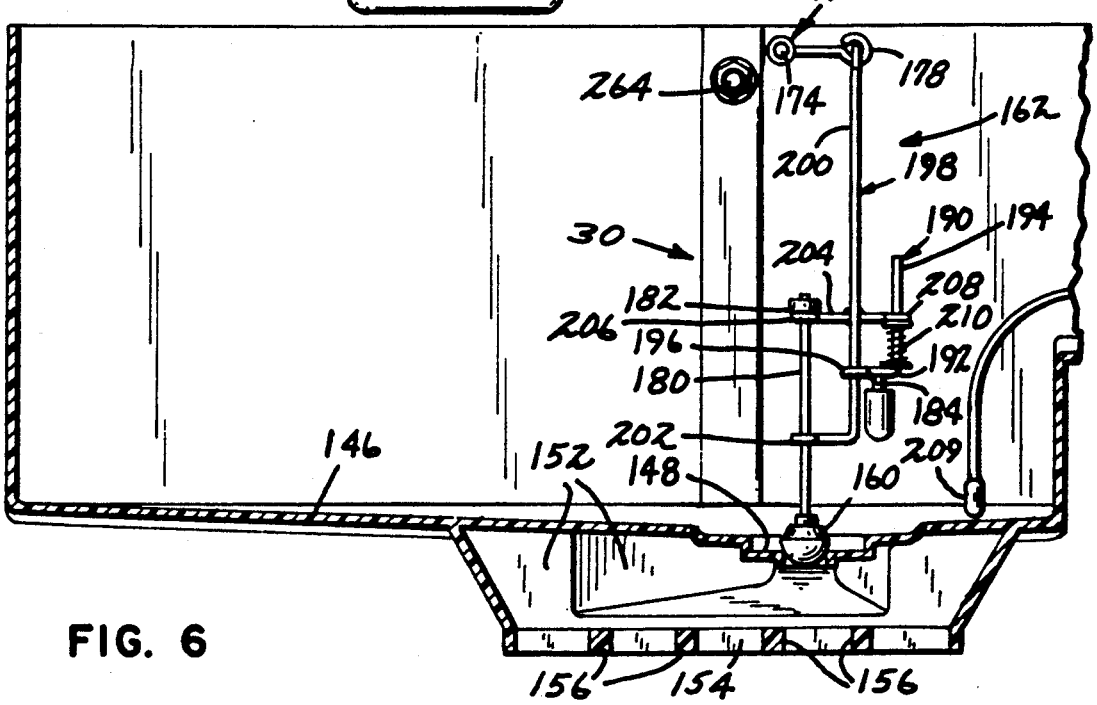
FIG. 6 is a cross-sectional view taken along line 6—6 of FIG. 3.

Reservoir 26 is necessarily shaped to fit, unless it is integral with cabinet 24, within the opening above board 130 and between side walls 140 and 142 and top 144 of cabinet 24. Thus, reservoir 26 may include a portion which is shaped to fit about compartment 132 as shown in FIG. 4. In addition, reservoir 26 has an open top and a bottom 146 which is slanted from side to side and end to end toward well 148. Well 148 includes a drain opening 150 (see FIG. 3). An elongated chamber 152 is located beneath bottom 146 to receive liquid draining through opening 150. Chamber 152 is elongated and centered with respect to tub 22. Chamber 152 includes near its tub or forward end an elongated output slot 154 having elements 156, as shown in FIG. 6, extending from side to side to divide slot 154 into a plurality of openings. Thus, as liquid is released through drain opening 150, the liquid tends to fill chamber 152 and drain from the plurality of openings along slot 154 to provide a waterfall effect when falling upon end 52 of tub 22.

Release of liquid contained within reservoir 26 is controlled by valve mechanism 30. Valve mechanism 30 includes control lever 158 and buoyancy plug 160 with linkage mechanism 162 therebetween. Linkage mechanism 162 is the subject matter of a copending application by the present inventor, said copending application hereby incorporated by reference. The copending application discloses three embodiments of linkage mechanism 162. Briefly, the embodiment of linkage mechanism 162 shown in FIGS. 3, 4 and 6, is as follows. Control lever 158 is rotatably mounted to a shaft 164 having second lever 166 attached thereto behind the front panel 168 of cabinet 24. A link 170 extends between lever 166 and the end of bellcrank 173 outside of reservoir 26. Support rod 174 extends rotatably between the front and back sides of reservoir 26. Support rod 174 is held in bosses 176 integral with the front and back sides. Bellcrank end 172 is attached to rod 174 forward of front side of reservoir 26. At a location along rod 174, the internal end 178 of the bellcrank 173 is attached.

As shown in FIG. 6, a vertical stem 180 rises from buoyancy plug 160. The upper end of stem 180 has a stop 182. A support rod 184 extends between the front and rear walls of reservoir 26 and has downwardly extending end portions which fit within openings in protrusions 188. Support rod 184 includes an L-shaped member 190. L-member 190 has a horizontal portion 192 and a vertical portion 194. The horizontal portion 192 is attached by weld or otherwise to support rod 184. The end of horizontal portion 192 has a loop 196 for encircling connect member 198. Connect member 198 has a substantially vertical portion 200 connected at the top end to internal portion 178 of bellcrank 173. At the lower end, connect member 198 has a bend to create a horizontal portion ending in a loop 202 which encircles stem 180. Connect member 198 further includes a cross member 204 attached to vertical portion 200 by weld or otherwise and having loops 206 and 208 at opposite ends. Loop 206 encircles stem 180 near stop 182, while loop 208 encircles vertical portion 194 of L-member 190. Loop 208 and loop 196 simply function to guide movement of connecting member 198.

Thus, when control lever 158 is moved to an open position, the bellcrank moves connect member 198 upwardly so that loop 182 engages stop 204 and pulls buoyant plug 160 from opening 150 thereby allowing liquid to exit. If it is desired to stop liquid from draining before all the liquid has drained, control lever 158 is moved to an off position whereby the internal portion 178 of the bellcrank moves connect member 198 downwardly so that loop 202 contacts the top of plug 160 and forces it downwardly into the flow of liquid leaving opening 150. As plug 160 moves into the flow, it becomes entrained and is forced rapidly into a plugging position in opening 150. Spring 210 is compressed by loop 208 against a washer on horizontal portion 192 when connect member 198 is moved downwardly. Therefore, when control lever 158 is released, spring 210 forces connect member 198 upwardly so that through the rest of the linkage control lever 158 is returned to its neutral position.

If all the liquid is allowed to drain, then plug 160 will drop into opening 150 by the force of its weight. Similarly, the weight of connect member 198 brings control lever 158 back to a neutral position.

It is noted that the temperature of the liquid or water in reservoir 26 is continuously monitored with sending unit 209 and readout 211 (see FIG. 4).

A source of liquid, commonly water, is connected through fill plumbing system 28 to fill reservoir 26 as required. The liquid or water source usually includes hot and cold water as shown at 212 and 214 in FIG. 2. As shown in FIG. 4, hot and cold water tubes 212 and 214 are connected to opposite sides of a mixing valve 216. Preferably tubes 212 and 214 are flexible. It is understood, however, that other plumbing materials, such as hard tubing could be used and that unions or quick disconnects could be reached through a panel in cabinet 24 whenever disconnection was necessary for cabinet movement or some other reason. Mixing valve 216 (see FIG. 1) preferably has a control handle 217 which may be set to obtain a desired temperature of water as shown on readout 218. Mixing valve 216 is connected at a third port to a tube 222 leading to shower unit 224. Shower unit 224 includes an on/off mechanism (not shown). A fourth port of mixing valve 216 leads to on/off valve 226 via hose 228. Hose 230 leads from valve 226 to float valve 232. As is known with float valves, when float 234 rises sufficiently, valve 232 is closed to prevent overflow within reservoir 26. When the liquid is drained from reservoir 26, float 234 drops and if on/off valve 226 is on, valve 232 is also on to allow water to automatically fill reservoir 26. It is understood, of course, that preferred valve mechanisms have been disclosed. Both the float valve 232 and valve mechanism 30 could be replaced with other equivalent mechanisms, for example, faucet, slide, butterfly, or ball valves and could be operated in conjunction with electrical circuitry.

As explained hereinbefore, liquid is released from reservoir 26 with dump valve mechanism 30. Reservoir 26 can hold sufficient liquid or water to fill tub 22 to a convenient bathing level regardless of whether a person is sitting on surface 44 or sitting in chair 236 of transfer unit 34. Bathing system 20 is further advantageous since a person may be bathed with shower 224 or he may soak in the water in tub 22 or circulating system 29 may be turned on to provide a whirlpool action with the water. Circulating system 29 includes an electric pump 238, as shown in FIG. 4, controlled by on/off switch 240. Pump 238 draws water or liquid from tub 22 at port 242 in vertical wall 244 between lower and upper surfaces 42 and 44. Using standard plumbing elements, tubing 246 leads from input port 242 to pump 238. Tubing 248 leads from pump 238 to a Tee 250. A first tube line 252 leads from Tee 250 to an output port 254 in end wall 52 of tub 22. The other tube line 256 leads from Tee 250 to output port 258 in one of the vertical walls of one of shelves 60. It is noted that output ports 254 and 258 direct water at directions orthogonal to one another thereby providing water circulation in two different directions. Also, output port 254 is elevated above output port 258 to further enhance the unique circulation pattern.

Air is inserted into liquid circulation system 29 to enhance the cleaning and therapeutic action of the water. Air is aspirated from port 260 through hose 262 for entrainment in water exiting from both of ports 254 and 258.

Drain system 31 includes overflow capabilities for both reservoir 26 and tub 22, as well as the usual drain feature for a tub. Overflow port 264 in reservoir 26 is connected by hose 266 to tubing 268. Tubing 268 leads from overflow port 270 in tub 22 to an external drain 272. Alternatively, the reservoir overflow could be arranged to fall directly into tub 22 from which liquid would drain to port 274. Port 274 in bottom surface 42 is connected by tubing 276 to the common drain 272 at Tee 278 with tubing 268. Drain port 274 is controlled by linkage 280 leading to a handle 282 recessed in side wall 38, as shown in FIG. 1.

Figure 2:
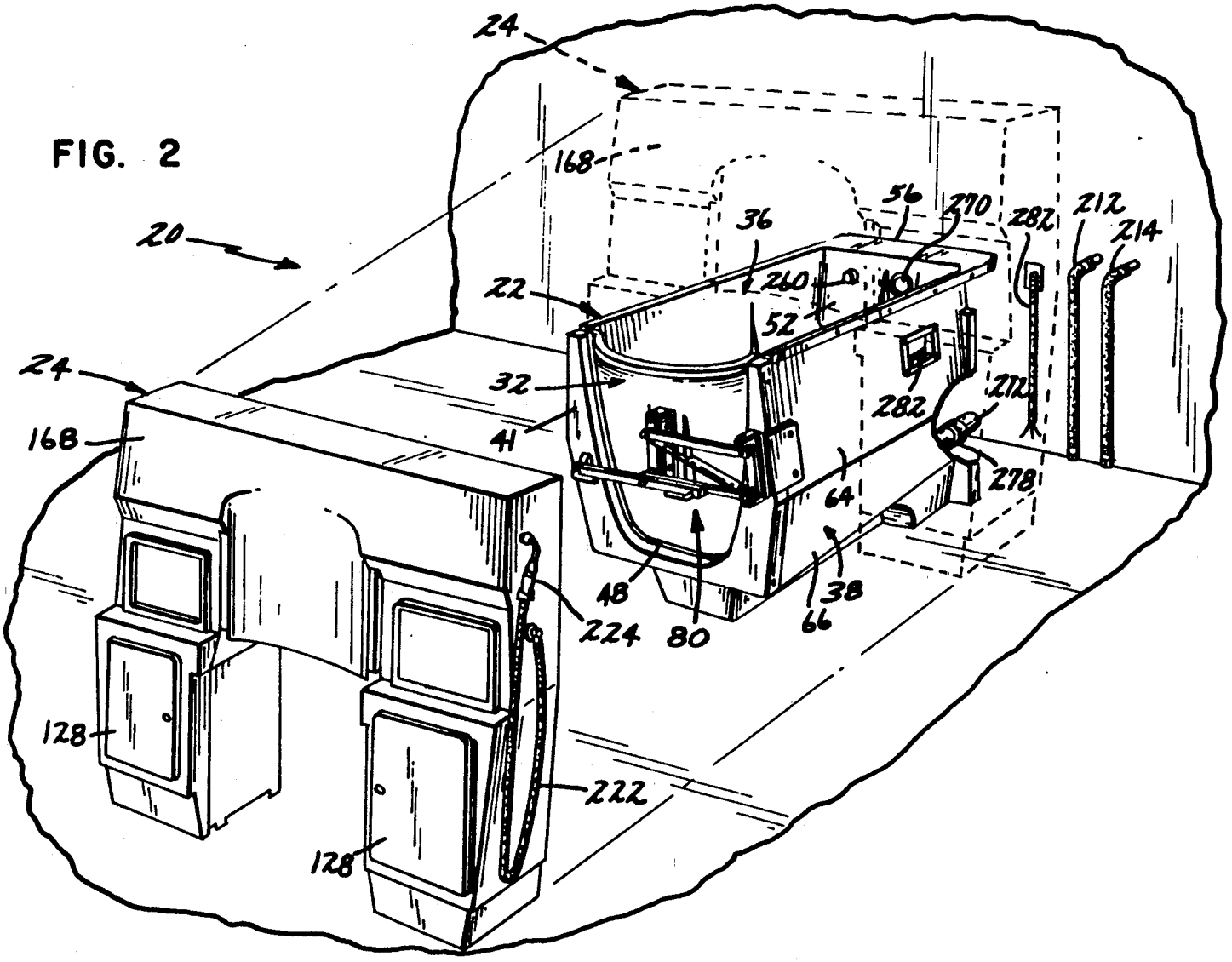
FIG. 2 is a perspective view showing in solid lines the reservoir support unit spaced away from the tub and showing in broken lines the support unit as commonly installed as shown in FIG. 1.

In use, as shown in FIG. 2, tub 22 is located for installation with respect to surrounding walls. Tee 278 of drain system 32 is connected by standard plumbing procedures to existing external drain 272. Support cabinet 24 for reservoir 26 is then slid past a portion of tub 22 to dotted position of FIG. 2. Support cabinet 24 has shelf portions which pass on opposite sides of the tub while the upper portion of cabinet 24 passes over the top of the tub. Preferably, flexible hoses are used to connect hot and cold water sources 212 and 214 to mixing valve 216. Next, electrical wiring 282 is connected in a standard fashion to circuitry controlling motor 284 which powers pump 238 and support cabinet 24 is slid past the remainer of tub 22 to a final installation location usually next to a wall. It is apparent that apparatus 20 of the present invention is conveniently configured so that at a later time support cabinet 24 may be slid out from the wall for cleaning, repair and replacement of components behind tub 22 and support cabinet 24.

Mixing valve 216 is preferably of a type wherein control lever 217 may be turned from an off position to a position which mixes hot and cold water. By turning on/off valve 228 on, water may then run through fill plumbing system 28 to fill reservoir 26. As the level of water rises, float 234 will rise and close float valve 232. In this state, apparatus 20 is ready for use either as a shower using hand held shower 224 or as a tub whereupon the water or liquid in reservoir 26 may be dumped into the tub for soaking or circulating.

A person may enter tub 22 by opening door 32. Door 32 is first unlocked by grasping one of handles 122 and rotating member 116 clockwise. As door 32 is unlocked, pneumatic piston and cylinder assembly 104 extends thereby raising door 32. Door 32 is rotated about pivot pins 100 and then rotated about pivot pins 98 to move the door through the door opening to an open position along side wall 38 as shown in FIG. 5. A person may walk into tub 22 or enter tub 22 on a transfer unit as shown in FIGS. 3 and 5. Briefly, the illustrated transfer unit supports the person on chair 236 with a carrier 286. Carrier 286 has a base 288 having a U-shape and supported by wheels 290. The U-shape of base 288 fits about one end of tub 22 and allows transfer unit 34 to move chair 236 through door 32 and into tub 22. Wheels 290 may fit into recesses 68 or may extend farther outwardly from them. Carrier 286 also includes a jack 292 for raising and lowering chair 236 with respect to base 288. Chair 236 has a plurality of flat portions with pivots at 294 and 296 which allow a person sitting on chair 236 to be positioned in various degrees of recline or seating.

With transfer unit 34 in place, door 32 is closed. That is, the opening procedure is reversed so that as member 116 is rotated counterclockwise to be received in the recess of receiver 118, door 32 compresses gasket 48 to seal the door to containing wall 36 of tub 22.

The water in reservoir 26 is now released by turning control handle 158 to the open position. Lever 166 also rotates to move link 170 thereby rotating portions 172 and 178 of bellcrank 173 so as to lift connect member 198. As connect member 198 is raised, loop 206 contacts stop 182 to lift stem 180 and plug 160 thereby releasing liquid through opening 150. The liquid runs into chamber 152 and through the plurality of openings in slot 154 to fall in the form of a waterfall on end wall 52. Thus, the filling of tub 22 is not only quick, but aesthetically pleasing to one sitting in chair 236.

If it is desired to stop the liquid release from reservoir 26, control handle 158 is turned to the off position which causes connect member 198 to move downwardly thereby pushing loop 202 against plug 160 so that plug 160 is caught in the flow of liquid toward opening 150. Plug 160 is forced into the opening to stop further release of liquid. Compression of spring 210 forces connect member 198 upwardly and through the linkages moves control level 158 back to the neutral position.

If reservoir 26 is emptied, it will automatically refill since float 234 has caused float valve 232 to open. The automatic refill feature, of course, may be overcome with on/off valve 228. Thus, the automatic refill feature provides for fresh, preheated water to be available for refill of tub 22 as soon as the bathing person finishes, and the tub is drained. Alternately, if the water in the tub becomes unduly soiled, it may be drained and without the person lingering too long in the tub, fresh water may be refilled therein to complete the bathing process.

With water in the tub, circulation system 29 may be turned on with switch 240. Motor 284 then powers pump 238 to force water out ports 254 and 258. The water entrains air from port 260. The orthogonally directed streams of water set up a circulation pattern within tub 22 which is very relaxing and very advantageous for cleaning. Water circulation continues as long as system 29 is operating since water is drawn through port 242 to the pump in a continuous flow pattern.

When it is desired to drain tub 22, handle 282 is lifted to move linkage 280 so that water may drain through port 274 and tube 276 to external drain 272. When the water is drained completely, door 32 is opened as before and the person on chair 236 is moved out through the door opening as transfer unit 34 is moved away from tub 22. Alternately, if the transfer unit 34 has not been used, the person may walk through the door opening to exit tub 22.

It is understood also that a transfer unit, wherein the chair is removed from the carrier the carrier moved from the tub, could also be used advantageously.

Thus, a number of advantages and details have been set forth. Yet, the description must be considered exemplary, since many of the features of the invention have numerous equivalents. Therefore, changes made, especially in matters of shape, size and arrangement, and combinations and type of various components and assemblies, to the full extent extended by the general meaning of the terms in which the appended claims are expressed, are within the principle of the present invention.

What is claimed is:

1. Apparatus for containing a liquid, comprising a tub having a wall with a door therein, said door for entry by a person, said tub also including means for operating said door, said door operating means including hinge means for swinging said door between open and closed positions, said hinge means including first and second means for pivoting said door, said first pivoting means swinging said door between the open and closed positions about a first axis located near a tub sidewall, said second pivoting means having a second axis near a vertical centerline of said door for angularly orienting said door with respect to a door opening in said tub, said hinge means including a pair of parallel connecting members having opposite ends pivotally attached to said first and second pivoting means, respectively, thereby forming a parallelogram shaped assembly for raising and lowering said door with respect to said tub, said door operating means further including means for sealing between said door and said tub and means for locking said door closed thereby maintaining the integrity of said sealing means, said sealing means including a seal element and wherein said locking means includes means for forcing said door from inside said tub to outside said tub against said seal element.

2. Apparatus for containing a liquid, comprising:

a tub having a wall with a door therein, said door for entry by a person, said tub also including means for operating said door, said door operating means including hinge means for swinging said door between open and closed positions, said hinge means including first and second means for pivoting said door, said first pivoting means swinging said door between the open and closed positions about a first axis located near a tub sidewall, said second pivoting means having a second axis near a vertical centerline of said door for angularly orienting said door with respect to a door opening in said tub, said hinge means further including a pneumatic cylinder extending between said first and second pivoting means for helping to raise and lower said door, said door operating means further including means for sealing between said door and said tub and means for locking said door closed thereby maintaining the integrity of said sealing means, said sealing means including a seal element and wherein said locking means includes means for forcing said door from inside said tub to outside said tub against said seal element.

3. Apparatus for containing a liquid, comprising:

a tub having a wall with a door therein, said door for entry by a person, said tub also including means for operating said door, said door operating means including hinge means for swinging said door between open and closed positions, said hinge means including first and second means for pivoting said door, said first pivoting means swinging said door between the open and closed positions about a first axis located near a tub sidewall, said second pivoting means having a second axis near a vertical centerline of said door for angularly orienting said door with respect to a door opening in said tub, said door operating means further including means for sealing between said door and said tub and means for locking said door closed thereby maintaining the integrity of said sealing means, said sealing means including a seal element and wherein said locking means includes means for forcing said door from inside said tub to outside said tub against said seal element, said locking means including a lock member pivotably attached to said second pivoting means, said locking means further including a receiver member attached to said tub near a side of said door opposite said second pivoting means, said lock member engaging said receiver member to lock said door closed with respect to said tub.

4. Apparatus for containing a liquid, comprising:

a tub having a wall with a door therein, said tub including first means for limiting liquid therein to a maximum fill level, said door for entry by a person, said tub also including means for operating said door, said door operating means including hinge means for swinging said door between open and closed positions, said hinge means including first and second means for pivoting said door, said first pivoting means swinging said door between the open and closed positions about a first axis located near a tub sidewall, said second pivoting means having a second axis near a vertical centerline of said door for angularly orienting said door with respect to a door opening in said tub, said hinge means further including a pneumatic cylinder extending between said first and second pivoting means for helping to raise and lower said door, said door operating means further including means for sealing between said door and said tub and means for locking said door closed thereby maintaining the integrity of said sealing means, said sealing means including a seal element and wherein said locking means includes means for forcing said door from inside said tub to outside said tub against said seal element;

a reservoir with a bottom, said bottom having a drain therein, said drain being higher in elevation than the maximum fill level of said tub and leading to said tub;

means for supporting said reservoir;

means for filling said reservoir with liquid, said filling means including means for regulating liquid temperature, said filling means further including second means for limiting said liquid in said reservoir to a predetermined quantity which fills said tub to a level no higher than said maximum fill level when released into said tub;

means for releasing all said predetermined quantity of liquid in said reservoir to fall from said drain into said tub; and means for draining said tub;

whereby said filling means with said temperature regulating means and said second limiting means fills said reservoir with a predetermined quantity of desirably heated liquid which when discharged by said releasing means falls downwardly to said tub to fill said tub to a level no higher than the maximum fill level.

5. Apparatus for containing a liquid, comprising:

a tub having a wall with a door therein, said tub including first means for limiting liquid therein to a maximum fill level, said door for entry by a person, said tub also including means for operating said door, said door operating means including hinge means for swinging said door between open and closed positions, said hinge means including first and second means for pivoting said door, said first pivoting means swinging said door between the open and closed positions about a first axis located near a tub sidewall, said second pivoting means having a second axis near a vertical centerline of said door for angularly orienting said door with respect to a door opening in said tub, said hinge means including a pair of parallel connecting members having opposite ends pivotally attached to said first and second pivoting means, respectively, thereby forming a parallelogram shaped assembly for raising and lowering said door with respect to said tub, said door operating means further including means for sealing between said door and said tub and means for locking said door closed thereby maintaining the integrity of said sealing means, said sealing means including a seal element and wherein said locking means includes means for forcing said door from inside said tub to outside said tub against said seal element;

a reservoir with a bottom, said bottom having a drain therein, said drain being higher in elevation than the maximum fill level of said tub and leading to said tub;

means for supporting said reservoir;

means for filling said reservoir with liquid, said filling means including means for regulating liquid temperature, said filling means further including second means for limiting said liquid in said reservoir to a predetermined quantity which fills said tub to a level no higher than said maximum fill level when released into said tub;

means for releasing all said predetermined quantity of liquid in said reservoir to fall from said drain into said tub; and means for draining said tub;

whereby said filling means with said temperature regulating means and said second limiting means fills said reservoir with a predetermined quantity of desirably heated liquid which when discharged by said releasing means falls downwardly to said tub to fill said tub to a level no higher than the maximum fill level.

6. A bathing system in accordance with claim 5 wherein said hinge means includes a spring extending between said first and second pivoting means for helping to raise and lower said door.

7. Apparatus for containing a liquid, comprising:

a tub having a wall with a door therein, said tub including first means for limiting liquid therein to a maximum fill level, said door for entry by a person, said tub also including means for operating said door, said door operating means including hinge means for swinging said door between open and closed positions, said hinge means including first and second means for pivoting said door, said first pivoting means swinging said door between the open and closed positions about a first axis located near a tub sidewall, said second pivoting means having a second axis near a vertical centerline of said door for angularly orienting said door with respect to a door opening in said tub, said door operating means further including means for sealing between said door and said tub and means for locking said door closed thereby maintaining the integrity of said sealing means, said sealing means including a seal element and wherein said locking means includes means for forcing said door from inside said tub to outside said tub against said seal element, said locking means including a lock member pivotably attached to said second pivoting means, said locking means further including a receiver member attached to said tub near a side of said door opposite said second pivoting means, said lock member engaging said receiver member to lock said door closed with respect to said tub;

a reservoir with a bottom, said bottom having a drain therein, said drain being higher in elevation than the maximum fill level of said tub and leading to said tub;

means for supporting said reservoir;

means for filling said reservoir with a liquid, said filling means including means for regulating liquid temperature, said filling means further including second means for limiting said liquid in said reservoir to a predetermined quantity which fills said tub to a level no higher than said maximum fill level when released into said tub;

means for releasing all said predetermined quantity of liquid in said reservoir to fall from said drain into said tub; and means for draining said tub;

whereby said filling means with said temperature regulating means and said second limiting means fills said reservoir with a predetermined quantity of desirably heated liquid which when discharged by said releasing means falls downwardly to said tub to fill said tub to a level no higher than the maximum fill level.

* * * * *